United States Patent [19]

Kondo et al.

[11] 4,426,559

[45] Jan. 17, 1984

[54] PUSH BUTTON SWITCH HAVING TWO RESILIENT CONTACTS OPERATED AT DIFFERENT TIMES

[75] Inventors: Shiro Kondo, Furukawa; Ken Mizuta, Miyagi, both of Japan

[73] Assignee: Alps Electric Co., Ltd., Tokyo, Japan

[21] Appl. No.: 333,731

[22] Filed: Dec. 23, 1981

[30] Foreign Application Priority Data

Dec. 24, 1980 [JP] Japan ..... 55-185811

[51] Int. Cl.[3] ..... H01H 21/40

[52] U.S. Cl. ..... 200/67 DB; 200/246; 200/16 R; 200/159 A

[58] Field of Search ..... 200/67 D, 67 DA, 67 DB, 200/159 A, 159 R, 245, 246, 247, 16 R

[56] References Cited

U.S. PATENT DOCUMENTS

| | | | |
|---|---|---|---|
| 1,215,665 | 2/1917 | Landis | 200/67 DB |
| 2,368,193 | 1/1945 | Boynton | 200/67 DA X |
| 2,923,787 | 2/1960 | Nelson | 200/67 |
| 3,873,078 | 3/1975 | Walt | 200/67 DB X |
| 3,898,402 | 8/1975 | Ford | 200/67 |
| 3,899,648 | 8/1975 | Murata | 200/5 R |
| 3,982,086 | 9/1976 | Marquardt et al. | 200/67 DA |
| 4,002,871 | 1/1977 | Sims, Jr. | 200/159 A |
| 4,002,879 | 1/1977 | Sims, Jr. | 200/159 A |
| 4,186,290 | 1/1980 | Matsuo | 200/159 A |
| 4,190,751 | 2/1980 | Roth et al. | 200/159 A X |
| 4,249,055 | 2/1981 | Matsuo | 200/159 |
| 4,385,218 | 5/1983 | Nishida | 200/159 A |

FOREIGN PATENT DOCUMENTS

| | | | |
|---|---|---|---|
| 2740875 | 3/1979 | Fed. Rep. of Germany | 200/67 D |
| 57-107241 | of 1982 | Japan . | |
| 685569 | 1/1953 | United Kingdom | 200/67 DB |

*Primary Examiner*—Stephen Marcus
*Assistant Examiner*—Ernest G. Cusick
*Attorney, Agent, or Firm*—Guy W. Shoup; Gerard F. Dunne

[57] ABSTRACT

Disclosed is a two-motion push-button switch comprising first and second switch portions, each including a movable contact piece 4 formed of a thin elastic metal plate, which has a reversing portion **4*b* provided with a movable contact portion and arms 4*a* and 4*a'* formed to grip the reversing portion therebetween, an auxiliary spring 9 or 9' to be engaged with said arms and a fixed contact portion 2*a* or 3*a* formed at a position confronting the movable contact portion in a case 1 or 6, wherein the movable contact pieces are reversed by one slider 5** dismountably disposed in the case to drive said two switch portions and the reversing force by the movable contact piece and auxiliary spring constituting the first switch portion is different from the reversing force by the movable contact piece and auxiliary spring constituting the second switch portion.

5 Claims, 5 Drawing Figures

PUSH BUTTON SWITCH HAVING TWO RESILIENT CONTACTS OPERATED AT DIFFERENT TIMES

BACKGROUND OF THE INVENTION (1) Field of the Invention

The present invention relates to a push-button switch. More specifically, the present invention relates to a push-button switch of the momentary motion type in which the thickness of the switch is reduced, a light switching touch is obtained and two-motion change-over operation is possible.

(2) Description of the Prior Art

A two-motion push-button switch is used for various purposes. For example, it is used in a tape recorder or the like to perform the switching operation of the running speed of the tape to move the tape at an ordinary speed or a higher speed, and in adjusting the indicating hands of an electric clock, the two-motion push-button switch is used for performing the switching operation of the rotation speed and turning the hands at a higher speed. Furthermore, the two-motion push-button switch is combined with an electric circuit and is used as a pulse-generating swtich.

Various push-button switches of this type differing in structure have heretofore been proposed. However, these switches typically have a complicated structure and are often large in their dimensions. In the field of electronic appliances such as radio sets and television sets, diversification of the functions, reduction of the size and enhancement of the quality and capacity have been desired, and development of a push-button switch of this type which is reduced in size and can be operated by a small driving force with a good operation touch is desired.

SUMMARY OF THE INVENTION

The present invention is to provide a two-motion push-button switch meeting the above requirements. More specifically, in accordance with the present invention, there is provided a two-motion push-button switch of a simple structure with small size and reduced thickness, in which a light switching operation touch can be obtained by reversing operations of a reversing spring formed by a thin, electrically conductive metal plate high in resiliency and having contact pieces. Auxiliary springs are disposed to enable two-motion switching operations and the reversing spring contact pieces are pressed in the direction along planes thereof.

The present invention will now be described in detail with reference to the accompanying drawings illustrating one embodiment of the present invention.

DETAILED DESCRIPTION OF THE PREFERRED EMBODIMENT

Figure 1:
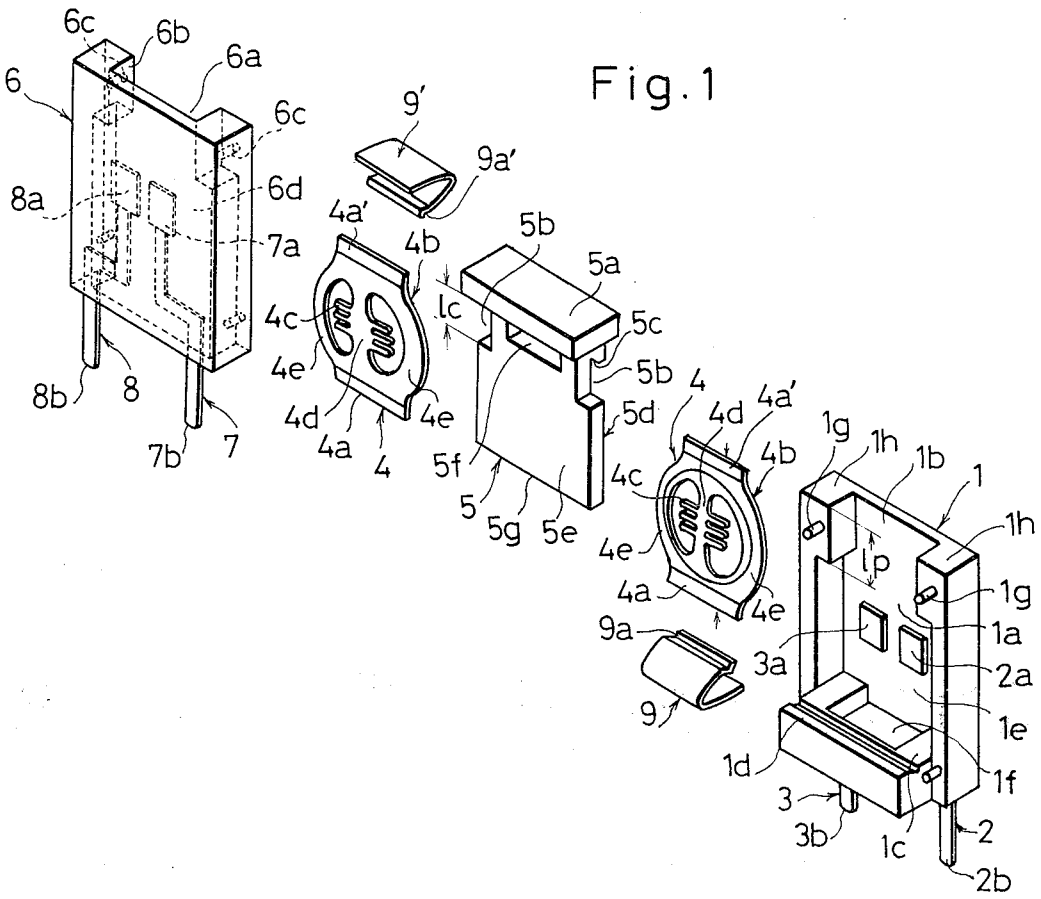
FIG. 1 is a fragmentary perspective view illustrating the structure of one embodiment of the two-motion push-button switch according to the present invention.
Figure 2:
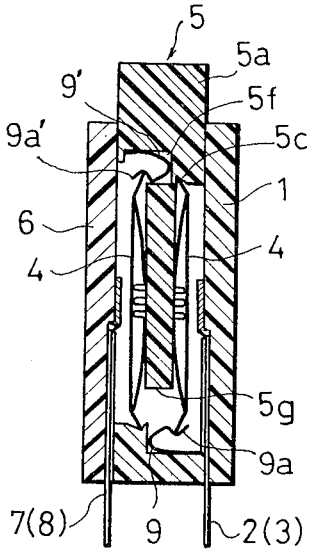
FIG. 2 is a sectional side view of the push-button switch shown in FIG. 1.
Figure 3A:
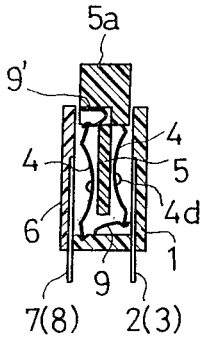
FIGS. 3(*a*) to 3(*c*) are sectional side views illustrating the operations of the push-button switch shown in FIG. 1.
Figure 3B:
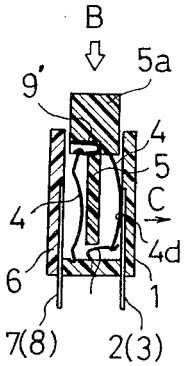
Figure 3C:
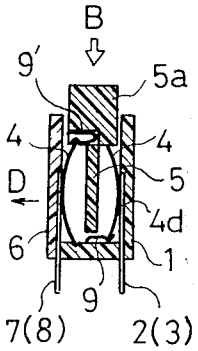

Referring to the drawings in which FIG. 1 is a fragmentary perspective view showing the structure of the push-button switch of the present invention, FIG. 2 is a sectional view of the push-button switch of the present invention and FIGS. 3(*a*), 3(*b*) and 3(*c*) are diagrams illustrating the operations of the push-button switch of the present invention, a first case 1 is molded from a synthetic resin and comprises an open concave portion 1*a*, an opening 1*b* formed in the upper side wall shown in FIG. 1 and a side wall 1*c* confronting said opening 1*b* and projecting outward at a right angle from a bottom 1*e*. Grooves 1*d* having a V-shaped section and a concave portion 1*f* for receiving auxiliary springs described hereinafter are formed in the side wall 1*c*, posts 1*g* are formed at the four corners of the side walls for attachment of a case portion described hereinafter and projections 1*h* are formed at the two upper corners as shown in FIG. 1. In the bottom of the concave portion 1*b* are fixed contact pieces 2 and 3 providing fixed contacts 2*a* and 3*a*, and external connection terminals 2*b* and 3*b* connected to the fixed contacts extend from the surface of the bottom 1*e* of the case 1. Incidentally, the fixed contact pieces 2 and 3 are fixed to the case simultaneously with the molding of the case by arranging the contact pieces in a mold and insert-molding a synthetic resin in the mold. A movable contact piece 4 forming a movable contact of first and second switch portions is integrally formed from a thin, electrically conductive metal plate high in resiliency, and the movable contact piece 4 comprises a pair of arms 4*a* and 4*a'* formed on respective ends of the contact piece, and a reversing portion 4*b* held between the arms 4*a* and 4*a'*. A part of the reversing portion 4*b* is punched to provide a movable contact portion 4*d* divided into a plurality of segments and having tongue pieces 4*c* and connecting portions 4*e*. The tongue pieces 4*c* are bend outwardly for engagement with the fixed contacts 2*a* and 3*a*, as will be set forth more fully below. When a force is applied to the arms 4*a* and 4*a'* in the direction indicated by the arrows in FIG. 1, the reversing portion 4*b* is urged outwardly toward the fixed contacts 2*a* and 3*a*. In order to promote this reversing action, the arms 4*a* and 4*a'* are slightly folded with a certain angle on the bases thereof. A slider 5 comprises a push-button portion 5*a*, notches 5*b* to be engaged with the projections 1*h* formed on the case 1, a jaw portion 5*c* formed on one face 5*d* and a concave portion 5*f* formed on the other face 5*e* at a position confronting the jaw portion 5*c* to receive an auxiliary spring. The length lc of the notches 5*b* is larger than the length lp of the projections 1*h*, so that the slider 5 moves in and out along a length (lc−lp) within the concave portion 1*a* of the case 1. One arm 4*a'* of the movable contact piece 4 is engaged within the jaw portion 5*c*. Reference numeral 5*g* represents an end portion. A second case 6 constituting a switch case in combination with the above-mentioned first case 1, which has a substantially channel shape, comprises a concave portion 6*a*, projections 6*b* and holes 6*c* corresponding to the concave portion 1*a*, projections 1*h* and post 1*g* of the first case 1. Fixed contact portions 7*a* and 8*a* are exposed on a bottom 6*d* of the concave portion 6*a* and fixed contact pieces 7 and 8 having external connection terminals 7*b* and 8*b* are integrally formed by insert-molding.

Auxiliary springs 9 and 9' are formed of a thin metal plate high in resiliency and are bent to have a substantially U-figured shape. V-figured anchoring grooves 9*a* and 9*a'* are formed on free ends to support one arm of a movable contact piece 4. Resilient forces of the auxiliary springs are determined relative to the pressing force necessary for reversing of the movable contact piece 4. In the present embodiment, the resilient force of the auxiliary spring 9 is made larger than that of the auxiliary spring 9' and also larger the force required for reversing of the movable contact piece 4, while the resilient force of the auxiliary spring 9' is smaller than the force required for reversion of the movable contact piece 4.

Assembling of the push-button switch of the present invention will now be described. First, the auxiliary spring 9 is inserted in the concave portion 1*a* of the case 1 so that the free end is directed towards the bottom 1*e* and the anchoring groove 9*a* is located above. Then, one arm 4*a* of a movable contact piece 4 is engaged with and fitted in the groove 9*a* formed on the auxiliary spring 9. Then, the slider 5 is arranged in the opening 1*b* of the concave portion 1*a* of the case 1, and the other arm 4*a'* is engaged with the jaw portion 5*c* of the slider 5. In this state, the slider 5 is slightly pushed in the direction pressing the movable contact piece 4 to engage the notches 5*b* with the projections 1*h* of the case 1, whereby the movable contact piece 4 is held on the case through the slider 5 on one side and through the auxiliary spring 9. Furthermore, the central part of the bent movable contact portion 4*d* of the movable contact piece 4 is brought into close contact with the surface 5*d* of the slider 5. The slider 5 is always urged outwardly by the spring force of the movable contact piece 4, and the push button portion 5*a* is projected from the case 1.

Then, the auxiliary spring 9' is inserted in the concave portion 5*f* formed on the other face 5*e* of the slider 5 so that the anchoring groove 9*a'* confronts the V-shaped groove 1*d* formed on the side wall 1*c* of the case 1. Then, the arm 4*a'* of another movable contact piece 4 is engaged with the anchoring groove 9*a'* of the auxiliary spring 9' and the other arm 4*a* is engaged with the groove 1*d* of the side wall 1*c*, so that the auxiliary spring 9' is slightly bent upward, whereby the movable contact piece 4 forming the second switch portion is held on the case 1 on one side and on the slider 5 through the auxiliary spring 9' on the other side. Thus, the central part of the bent movable contact portion 4*d* is brought in close contact with the other face 5*e* of the slider 5. Then, the second case 6 is fixed by inserting the poles 1*g* of the first case 1 into the holes 6*c* so that the movable contact portion 4*d* of the movable contact piece 4 confronts the fixed contact portions 7*a* and 8*a*, whereby assembling is completed, as shown in FIG. 2.

The operations of the push-button switch of the present invention will now be described with reference to FIGS. 2 and 3.

In the state where the push-button portion 5*a* is not depressed, as shown in FIGS. 2 and 3(*a*), the slider 5 is urged upward by the movable contact pieces 4 and auxiliary springs 9 and 9' and the contact portions 4*d* of the movable contact pieces 4 of the first and second switch portions are kept in the non-contact state with the confronting fixed contact portions 2*a* and 3*a* of the fixed contact pieces 2 and 3 and the switch is off. The movable contact portion 4*d* of the second switch portion is also kept in the non-contact state with the fixed contact portions 7*a* and 8*a* of the fixed contact pieces 7 and 8.

When the push-button portion 5*a* is depressed in the direction of arrow B in this state, since the auxiliary spring 9 has a larger elastic force than the movable contact piece 4 of the first switch portion, the initial shape is substantially retained in the auxiliary spring 9, and the arms 4*a* and 4*a'* of the movable contact piece 4 are bent in the direction of arrow C of FIG. 3(*b*). When the push-button portion 5*a* is further depressed in the direction of arrow B, the connecting portions 4*e* of the movable contact piece 4 and the movable contact portion 4*d* are reversed suddenly in the direction of arrow C. The tongue pieces 4*c* of the movable contact portion 4*d* are pressed to the fixed contact portions 2*a* and 3*a* by the repulsive force of the movable contact piece 4 to produce the switch-on state.

Since the resilient force of the auxiliary spring 9' of the second switch portion is smaller than that of the movable contact piece 4, the auxiliary spring 9' is bent and the original state of the movable contact piece 4 is substantially retained, and the switch-on state is maintained. When the push-button portion 5*a* is further depressed in the state shown in FIG. 3(*b*), the end 5*g* of the slider 5 is brought into contact with the back face of the auxiliary spring 9 to further bend the auxiliary spring 9, and the reversed movable contact piece 4 slides downward with sliding of the slider 5 while keeping the switch-on state.

In the second switch portion, the auxiliary spring 9' is bent and the free end thereof is kept in the contacted state, and further pressing force acts directly on the movable contact piece 4, whereby the connecting portions 4*e* and movable contact portion 4*d* of the movable contact piece 4 are reversed suddenly in the direction of arrow D. The tongue pieces 4*c* of the movable contact portion 4*d* are pressed to the fixed contact portions 7*a* and 8*a* by the repulsive force of the movable contact piece 4 to produce the switch-on state, as shown in FIG. 3(*c*). The movement range of the slider 5 is limited by the length lc of the notches 5*b* and the length lp of the projections 1*h* so that an unnecessarily large pressing force is not applied. When the pressing force is released in the state where the push-button portion 5*a* is pressed to the last extremity, the state shown in FIG. 3(*a*) is restored to produce the switch-off state.

According to the present invention, the first switch portion and second switch portion are fabricated so that the reversing portion having a bent shape is formed by molding a thin, electrically conductive metal plate high in resiliency, the movable contact portion having tongue pieces is formed in the vicinity of the reversing portion and arms are formed on both the ends of the reversing portion to form a reversing spring movable contact piece, the movable contact portion is arranged in the case so that the movable contact portion confronts the fixed contact portion, and by pressing the tongue pieces in the direction of the length of the movable contact piece, the reversing portion is reversed in a direction rectangular to the pressing direction to cause disconnection. Furthermore, a reversing spring is disposed on one end of the movable contact piece, and the resilient force of one auxiliary spring is made larger than the resilient force required for reversion of the reversing spring movable contact piece while the resilient force of the other auxiliary spring is made smaller than the resilient force required for reversion of the reversing spring contact piece. Accordingly, the size of the push-button switch in the thickness direction can remarkably be reduced, and since the reversing action is transmitted to the finger, a very excellent changeover touch can be produced. Thus, a very excellent two-motion push-button switch can be provided according to the present invention.

In the foregoing embodiment, the resilient force of one auxiliary spring is made larger than the resilient force of the movable contact piece while the resilient force of the other auxiliary spring is made smaller than that of the movable contact piece. In the present invention, there may be adopted a modification in which the resilient force of one movable contact piece is made larger than that of the auxiliary spring while the resilient force of the other movable contact piece is made smaller than that of the auxiliary spring. The same excellent effects as described above can similarly be attained even if this modification is adopted.

What is claimed is:

1. A push button switch comprising first and second switch portions mounted in a case; each of said switch portions including a respective movable contact piece formed of a resilient metal plate having a central portion adapted to change its position suddenly upon application of a pressing force applied therealong, a respective movable contact portion carried by each said central portion, arms formed to hold the central portion therebetween, a respective auxiliary spring engaged with one of said arms of each contact piece and a fixed contact portion formed at respective positions in said case confronting the respective movable contact portions, and means including a single slider movable slidably within said case and adapted to apply pressing forces along each said movable contact piece with the pressing force necessary to change the position of a switch portion comprised by one movable contact piece and auxiliary spring being different from the pressing force necessary to change the position of the other switch portion comprised by the other movable contact and the other auxiliary spring.

2. A push-button switch as set forth in claim 1, wherein the pressing forces necessary to change the positions of the movable contact pieces of the first and second switch portions are made different from each other to make the pressing force of the movable contact piece and auxiliary spring in the first switch portion different from the pressing force by the movable contact piece and the auxiliary spring in the second switch portion.

3. A push-button switch as set forth in claim 1, wherein the resiliency of each of the auxiliary springs of the first and second switch portions are made different from each other to make the pressing force of the movable contact piece and auxiliary spring in the first switch portion different from the reversing force of the movable contact piece and auxiliary spring in the second switch portion.

4. A push button switch comprising a case having respective fixed contacts held in opposing wall portions thereof, a slider mounted in said case for sliding movement along said opposing wall portions, and means including first and second switch portions engaged by said slider and carrying respective movable contacts adapted to change their state of engagement with a respective one of said fixed contacts upon differing strokes of movement of said slider, said switch portions each being comprised by a respective contact piece formed of resilient material and having a central portion adapted to change its position suddenly upon movement of said slider and an auxiliary spring engaging the respective contact piece and deflectable by movement of said slider, the resiliency of said auxiliary springs being different to enable said central portions to change their positions during differing strokes of said slider.

5. A push button switch comprising a case having respective fixed contacts held in opposing wall portions thereof, a slider mounted in said case for sliding movement along said opposing wall portions, and means including first and second switch portions engaged by said slider and carrying respective movable contacts adapted to change their state of engagement with a respective one of said fixed contacts upon differing strokes of movement of said slider, said switch portions each being comprised by a respective contact piece formed of resilient material and having a central portion adapted to change its position suddenly upon movement of said slider and an auxiliary spring engaging the respective contact piece and deflectable by movement of said slider, the resiliency of said contact portions being different to enable said central portions to change their positions during differing strokes of said slider.

* * * * *